US005582032A

United States Patent [19]

Shelton et al.

[11] Patent Number: 5,582,032

[45] Date of Patent: Dec. 10, 1996

[54] ULTRA-HIGH PURITY OXYGEN PRODUCTION

[75] Inventors: James T. Shelton, deceased, late of Houston, Tex., by James E. Shelton, executor; Bao Ha, Vacaville, Calif.

[73] Assignee: Liquid Air Engineering Corporation, Houston, Tex.

[21] Appl. No.: 514,291

[22] Filed: Aug. 11, 1995

[51] Int. Cl.[6] ..... F25J 3/04; F25J 5/00

[52] U.S. Cl. ..... 62/643; 62/647; 62/648; 62/900

[58] Field of Search ..... 62/640, 643, 647, 62/648, 900, 903

[56] References Cited

U.S. PATENT DOCUMENTS

| | | | |
|---|---|---|---|
| 2,209,748 | 7/1940 | Schlitt | 62/647 |
| 2,729,954 | 1/1956 | Etienne | 62/643 |
| 3,127,260 | 3/1964 | Smith | 62/643 |
| 4,579,566 | 4/1986 | Brugerolle | 62/903 X |
| 4,615,716 | 10/1986 | Cormier et al. | 62/643 |
| 5,341,646 | 8/1994 | Agrawal et al. | 62/900 X |
| 5,363,656 | 11/1994 | Nagamura et al. | 62/647 |

*Primary Examiner*—Christopher Kilner
*Attorney, Agent, or Firm*—Robert D. Touslee

[57] ABSTRACT

A process for producing an ultra-high purity fluid product comprising the steps of collecting in the lower portion of a cryogenic fractionation zone an ultra-high purity fluid product; providing reboil to said fractionation zone by condensing a portion of a lesser purity composition of the same fluid product by indirect heat exchange in a first reboiler; and vaporizing said portion of said lesser purity composition by indirect heat exchange with a warmer stream of an impure fluid.

16 Claims, 2 Drawing Sheets

ULTRA-HIGH PURITY OXYGEN PRODUCTION

BACKGROUND OF THE INVENTION

Increasingly, many industries and industrial processes require a very high purity of oxygen in their processes and manufacturing systems. Due to today's more stringent purity requirements in, for example, the electronics industry, many existing production processes for oxygen separation from air may not be sufficient to produce consistent quantities of ultra-high purity oxygen gas. For uses requiring a purity in the parts-per-billion range, fractional distillation with even a very high number of stages may not be sufficient to provide ultra-high purity oxygen product.

Existing processes to produce ultra-high purity industrial gases often employ braised aluminum heat exchangers within the cryogenic columns. Such braised aluminum heat exchangers typically comprise many welds which by their very nature are susceptible to permeation between fluids and are, therefore, a risk for a source of potential contamination in the ultra-high purity product. An alternative to braised aluminum heat exchangers would be stainless steel shell and tube heat exchangers. However, the shell and tube exchangers would also necessarily contain welds which would also be susceptible to leaks of one fluid to the other.

Avoiding harmful permeation between dissimilar fluids and the resulting contamination of an ultra-high purity product of an air separation process is a substantial problem requiring a new solution.

SUMMARY OF THE INVENTION

In accordance with the present invention, a process and system for the production of an ultra-high purity product wherein said ultra-high purity product is produced from the bottom of a distillation column comprising at the bottom of said column a reboiler in fluid contact with said ultra-high purity product liquid and wherein the heat for reboil in said column is provided by indirect heat exchange in said reboiler by condensation of a high purity fluid which is vaporized by indirect heat exchange against a warm impure gas in a second, intermediate reboiler at a second pressure and temperature.

According to the process of the present invention, when an ultra-high purity product is being produced from the bottom of a distillation column and the heating medium fluid composition providing heat to reboil the column is substantially different from the composition of the ultra-high purity product, an intermediate reboiler is utilized to lessen the ultimate effect of any leak in either heat exchanger on the ultra-high purity product purity. Preferably, the composition of the intermediate heating medium is a high purity grade of the same fluid type, but not necessarily the extreme high purity of the ultra-high purity product to that of an ultra-high purity product composition. Accordingly, contamination of the ultra-high purity product is minimized if a leak or other permeation occurs in either the bottom or the intermediate reboiler.

We have found the process to produce ultra-high purity product to be particularly effective in producing ultra-high purity oxygen when the heating medium in the intermediate reboiler is nitrogen.

DETAILED DESCRIPTION OF PREFERRED EMBODIMENT

Figure 1:
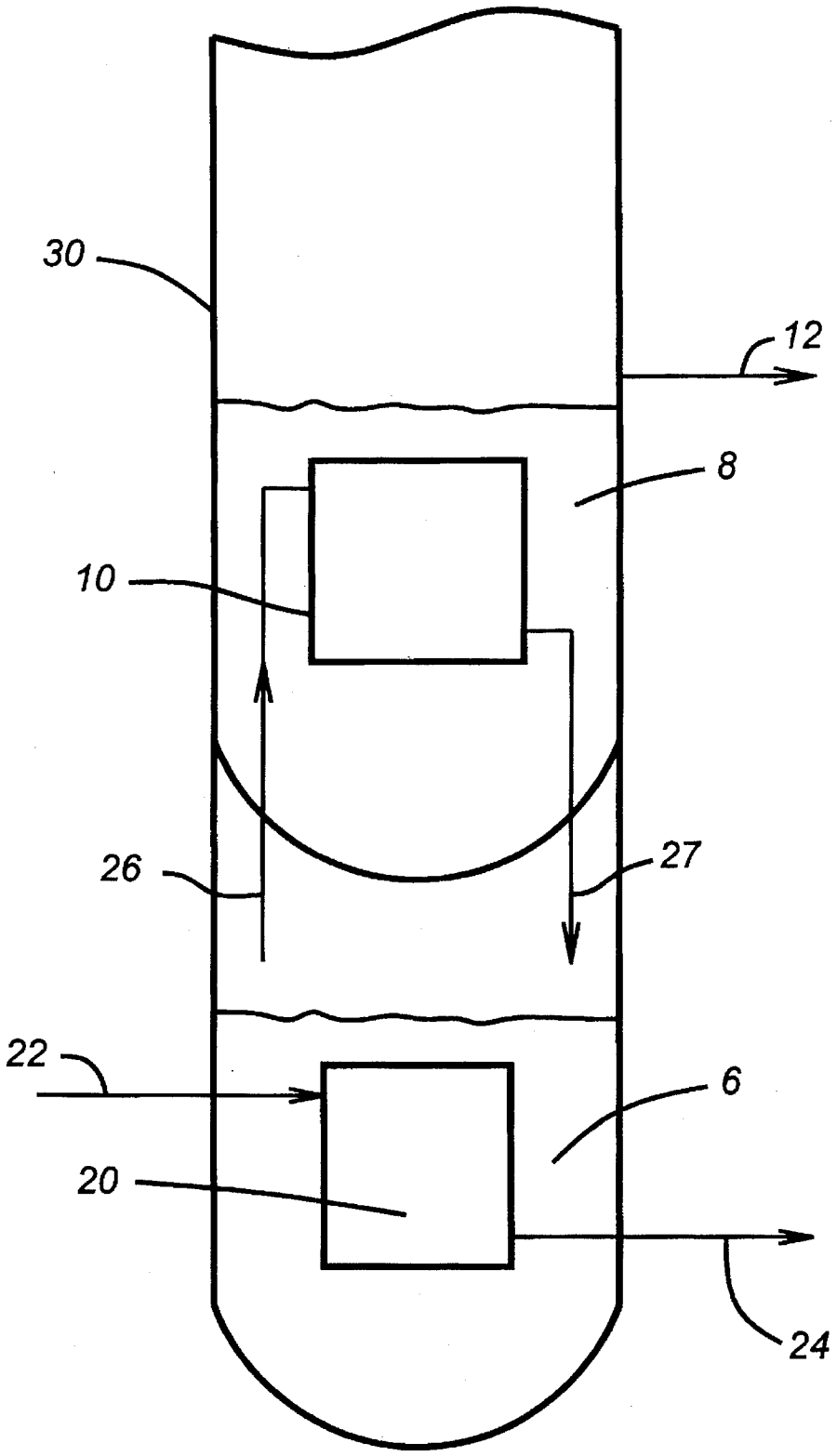
FIG. 1 depicts the bottom portion of a cryogenic column comprising the bottom reboiler and the intermediate reboiler of the present invention.

Referring now to FIG. 1, the lower portion of a cryogenic distillation column is depicted wherein ultra-high purity oxygen is produced via line 12 containing very low levels of impurities. A reboiler 10 is in indirect heat exchange relationship with collected ultra-high purity oxygen fluid 8 in the sump of the distillation column. Providing heat for vaporizing at least a portion of the ultra-high purity oxygen product is a high purity fluid, in this case, preferably commercial grade oxygen vapor conveyed to reboiler 10 via conduit 26. It is preferable the reboiler 10 is located within a separate compartment section of column 30. In this case, the separate section is positioned under the reboiler 10 wherein commercial grade oxygen is vaporized to provide heat input to reboiler 10.

Following vaporization and transport of the intermediate high purity fluid, in this case, commercial grade oxygen, to reboiler 10, condensed commercial grade oxygen is drained from reboiler 10 and returned to the separate section via conduit 27. In the separate section, commercial grade oxygen 6 collects around a second reboiler 20 in which heat input is provided by a warm impure stream 22. In this preferred case, where the ultra-high purity product is commercial grade oxygen, a preferred warm impure stream is recycled nitrogen. Warm cycle nitrogen provides heat to reboiler 20 to vaporize a portion of commercial grade oxygen 6, and thereby makes heat input available to reboiler 10 as described above.

In accordance with the present invention, if a leak or other permeation in reboiler 20 were to occur, contamination of the intermediate fluid, in this case commercial grade oxygen, would not directly contaminate the ultra-high purity oxygen product 8. Further, according to our invention, if a leak were to occur in reboiler 10, the relatively low level of impurities in the intermediate fluid, in this case commercial grade oxygen, would not lead to any substantial contamination of the ultra-high purity product.

It is not necessary that the reboilers be in the vertical configuration depicted in FIG. 1, but only that vaporized intermediate fluid is available via conduit means to supply the reboiler vaporizing liquid in the sump of column 30. Typically, there are no distillation stages above reboiler 20 in the separate section, but only means to convey the vaporized intermediate fluid to the reboiler in the distillation column.

Figure 2:
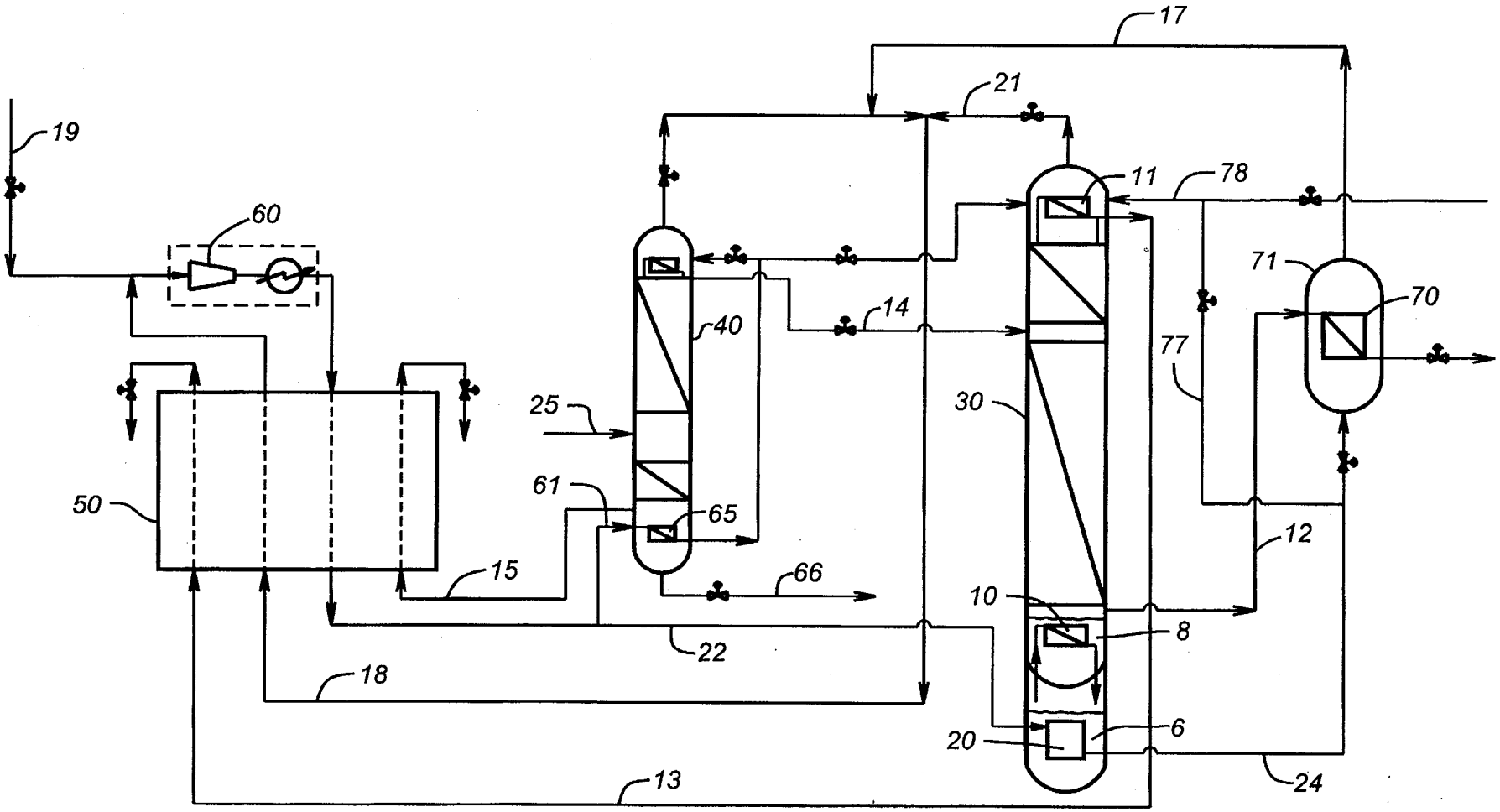
FIG. 2 depicts an overall purification process to produce an ultra-high purity oxygen product.

Referring now to FIG. 2 wherein the intermediate and primary reboilers are employed in an oxygen purification process, further features and advantages will be described. A cryogenic distillation column 30 is fed with an oxygen feed stream 14. The oxygen feed is substantially free of hydrocarbons, having been removed in column 40 via conduits 15 and 66 previous to the feed flowing to distillation column 30. A liquid oxygen feed enters column 40 via line 25 from an outside source. Nitrogen provides boil-up to column 40 via line 61 and reboiler 65, and substantially all hydrocarbon is purged via line 15. Oxygen feed 14 enters column 30 at an intermediate location, and overhead condenser 11 is purged of argon and any other light impurities via line 13. In the base of column 30, ultra-high purity oxygen product 8 is collected, and reboil to the column is provided via reboiler 10. Supplying heat to reboiler 10 is a condensing portion of an intermediate high purity fluid preferably substantially oxygen. Preferably in this case, the intermediate fluid is commercial grade oxygen which liquid is collected in the bottom of a separate section of column 30.

According to our invention, a portion of the intermediate fluid is vaporized against a warm impure fluid via reboiler 20. By "impure fluid" it is meant a fluid of composition so different from that of the ultra-high purity product that any leakage into the ultra-high purity product would lead to an undesirable contamination of the ultra-high purity product. Ultra-high purity product is removed via line 12 and recondensed against recycled nitrogen in line 24 in heat exchanger 70 within recondenser 71. Cycle nitrogen is returned via line 17 and 18 to cycle compressor 60 and returned for reuse in the purification process. Preferably, a portion of nitrogen is flowed via conduits 77 and 78 to condenser 11. Heat exchanger 50 recovers cold from vent streams and cools compressed cycle nitrogen to provide energy efficiency and balance.

The oxygen purification process depicted in FIG. 2 is a preferred employment of the present invention. However, any cryogenic distillation wherein an ultra-high purity product is produced from the bottom of the distillation column may employ the present invention to achieve a desirous result of lesser risk of contamination. Preferably, when the ultra-high purity product is oxygen, it comprises less than 20 parts-per-billion impurities. More preferably, less than about 10 parts-per-billion impurities, most preferably, less than about 3 parts-per-billion impurities. Moreover, where the ultra-high purity product is oxygen produced at a pressure of between about 5 psig and about 10 psig, the intermediate fluid is condensed at a pressure of between about 8 psig and about 20 psig, where the intermediate fluid is commercial grade oxygen. By the term "commercial grade oxygen" it is meant an oxygen having a purity of about 99.9% oxygen. Further, where the heating medium to vaporize at least a portion of the intermediate fluid is cycle nitrogen, it is preferred the nitrogen be delivered to the reboiler 20 at a pressure of between about 60 psig and about 110 psig.

The present invention also contemplates a system for producing ultra-high purity fluid wherein the system comprises a distillation column having a reboiler in the bottom portion thereof. A second reboiler, not necessarily, but preferably in the same vessel as the distillation column is provided to vaporize at least a portion of an intermediate heating fluid. Conduit means are provided to convey the vaporized portion of the heating medium to the reboiler in the distillation column and also to return condensed intermediate heating fluid from the reboiler 10 to the sump surrounding reboiler 20.

The preferred embodiments and figures are intended to represent a typical means for employing the process and system of the present invention, but are not intended to be limiting or reduce the scope of the invention, the scope and definition being solely dictated by the claims appended hereto. Those skilled-in-the-art will recognize variants to the physical equipment, or appurtenant steps and procedures, which are intended to be within the scope of the present invention.

What is claimed is:

1. A process for producing an ultra-high purity fluid product comprising the steps of:

(a) collecting in the lower portion of a cryogenic fractionation zone an ultra-high purity fluid product;

(b) providing reboil to said fractionation zone by condensing a portion of a lesser purity composition of the same fluid product by indirect heat exchange in a first reboiler; and (c) vaporizing said portion of said lesser purity composition by indirect heat exchange with a warmer stream of an impure fluid.

2. The process as recited in claim 1 wherein the ultra-high purity fluid product is oxygen and said lesser purity composition is commercial grade oxygen.

3. The process as recited in claim 2 wherein said ultra-high purity oxygen comprises less than 20 parts-per-billion impurities.

4. The process as recited in claim 1 wherein said impure fluid is nitrogen.

5. The process as recited in claim 4 wherein said fractionation column is an argon fractionation column for separating argon from a mixture of oxygen and argon in an oxygen purification process.

6. A process for producing an ultra-high purity oxygen product comprising the steps of:

(a) feeding liquid oxygen comprising impurities to a first fractional distillation column;

(b) separating impurities which are higher boiling than oxygen by fractionation in said first column to form an oxygen overhead stream substantially free of heavy impurities;

(c) feeding at least a portion of said oxygen overhead stream to a second cryogenic distillation column;

(d) providing reboil to said second distillation column by condensing a portion of a lesser purity grade of oxygen by indirect heat exchange in a first reboiler in the bottom of said second distillation column; and (e) vaporizing said portion of said lesser purity fluid by indirect heat exchange with a warmer stream of an impure fluid.

7. The process as recited in claim 6 wherein said warmer stream is cycle nitrogen.

8. The process as recited in claim 6 wherein said ultra-high purity oxygen is produced at a pressure of between about 5 psig and about 10 psig.

9. The process as recited in claim 8 wherein said lesser purity oxygen is condensed in said first reboiler at a pressure of between about 8 psig and about 20 psig.

10. The process as recited in claim 9 wherein said cycle nitrogen is conveyed to said second reboiler at a pressure of between about 60 psig and about 110 psig.

11. The process as recited in claim 6 wherein said ultra-high purity oxygen product comprises less than 10 parts-per-billion impurities.

12. The process as recited in claim 6 wherein said ultra-high purity oxygen product comprises less than 3 part per billion impurities.

13. A system for producing ultra-high purity fluid by cryogenic distillation comprising:

(a) a fractional distillation column having a first reboiler in the bottom portion thereof;

(b) a second reboiler to vaporize a portion of a fluid by indirect heat exchange;

(c) conduit means to convey said portion of vaporized fluid to said first reboiler for condensing at least a portion of said fluid in said first reboiler; and (d) means to convey a impure fluid to said second reboiler to provide heat for vaporizing said portion of said intermediate fluid.

14. The system as recited in claim 13 further comprising a heavy removal distillation column for separating components boiling higher than oxygen from a liquid oxygen feed stream and wherein said fractional distillation column is an argon column for separating argon from said oxygen overhead stream.

15. The system as recited in claim 13 further comprising a cycle nitrogen compressor and conduit means to convey compressed nitrogen to said second reboiler.

16. In a process for producing an ultra-high purity fluid collected in the bottom of a cryogenic distillation column having first a reboiler therein the improvement comprising:

(a) conveying a warm impure stream to a second reboiler to vaporize a portion of a lesser purity fluid and condensing a portion of said vaporized lesser purity fluid in said first reboiler to provide reboil for said distillation column and producing an ultra-high purity fluid from the said distillation column comprising less than 10 part per billion impurities.

* * * * *